US010844461B2

(12) United States Patent
Yuhong et al.

(10) Patent No.: US 10,844,461 B2
(45) Date of Patent: Nov. 24, 2020

(54) METHOD FOR MANUFACTURING QUASICRYSTAL AND ALUMINA MIXED PARTICULATE REINFORCED MAGNESIUM-BASED COMPOSITE MATERIAL

(71) Applicant: NORTH UNIVERSITY OF CHINA, Taiyuan (CN)

(72) Inventors: Zhao Yuhong, Taiyuan (CN); Hou Hua, Taiyuan (CN); Jin Yuchun, Taiyuan (CN); Wu Jinke, Taiyuan (CN); Yang Ling, Taiyuan (CN)

(73) Assignee: NORTH UNIVERSITY OF CHINA, Shanxi Province (CN)

( * ) Notice: Subject to any disclaimer, the term of this patent is extended or adjusted under 35 U.S.C. 154(b) by 142 days.

(21) Appl. No.: 16/140,820

(22) Filed: Sep. 25, 2018

(65) Prior Publication Data

US 2019/0024214 A1 Jan. 24, 2019

Related U.S. Application Data

(62) Division of application No. 15/016,390, filed on Feb. 5, 2016, now Pat. No. 10,113,216.

(30) Foreign Application Priority Data

Feb. 6, 2015 (CN) ..... 2015 1 0061456

(51) Int. Cl.
*C22C 1/02* (2006.01)
*B22D 1/00* (2006.01)
(Continued)

(52) U.S. Cl.
CPC ..... *C22C 1/02* (2013.01); *B22D 1/002* (2013.01); *B22D 21/007* (2013.01);
(Continued)

(58) Field of Classification Search
CPC . B22D 7/00; B22D 7/005; B22D 7/02; B22D 21/00; B22D 21/002; B22D 21/007;
(Continued)

(56) References Cited

U.S. PATENT DOCUMENTS 3,728,108 A * 4/1973 Sifferlen ..... C22C 1/1036 420/1
6,471,797 B1 10/2002 Kim et al.

FOREIGN PATENT DOCUMENTS

CN 103924140 A 7/2014
JP 5429702 B2 2/2014

OTHER PUBLICATIONS

Q. B. Nguyen and M. Gupta, "Microstructure and Mechanical Characteristics of AZ31B/Al2O3 Nanocomposite with Addition of Ca," Journal of Composite Materials, vol. 43, No. 01, 2009, pp. 5-17 (Year: 2009).*

(Continued)

*Primary Examiner* — Vanessa T. Luk
(74) *Attorney, Agent, or Firm* — Global IP Counselors, LLP

(57) ABSTRACT

A method for manufacturing a quasicrystal and alumina mixture particles reinforced magnesium matrix composite, includes manufacturing a quasicrystal and alumina mixture particles reinforcement phase, including preparing raw materials for the quasicrystal and alumina mixture particles reinforcement phase including a pure magnesium ingot, a pure zinc ingot, a magnesium-yttrium alloy in which the content of yttrium is 25% by weight, and nanometer alumina particles, the elements having the following proportion by weight 40 parts of magnesium, 50-60 parts of zinc, 5-10 parts of yttrium and 8-20 parts of nanometer alumina particles of which the diameter is 20-30 nm, pretreating the metal raw materials, cutting the pure magnesium ingot, the pure zinc ingot and the magnesium-yttrium alloy into
(Continued)

blocks, removing oxides attached on the surface of each metal block, placing the blocks into a resistance furnace to preheat at 180° C. to 200° C., and filtering out the absolute ethyl alcohol after standing, and drying.

6 Claims, 2 Drawing Sheets

(51) Int. Cl.

| | |
|---|---|
| ***C22C 32/00*** | (2006.01) |
| ***C22C 23/02*** | (2006.01) |
| ***B22D 21/00*** | (2006.01) |
| ***B22D 29/04*** | (2006.01) |
| ***B22D 27/00*** | (2006.01) |
| ***B22F 9/04*** | (2006.01) |
| ***C22C 1/10*** | (2006.01) |
| *B22D 7/00* | (2006.01) |

(52) U.S. Cl.
CPC ..... *B22D 27/003* (2013.01); *B22D 29/04* (2013.01); *B22F 9/04* (2013.01); *C22C 1/1036* (2013.01); *C22C 23/02* (2013.01); *C22C 32/0036* (2013.01); *B22D 7/005* (2013.01); *B22F 2009/043* (2013.01)

(58) Field of Classification Search
CPC . B22D 21/02; B22D 27/003; B22F 2301/058; B22F 2302/25; B22F 2302/253; C22C 1/00; C22C 1/02; C22C 1/026; C22C 1/03; C22C 1/04; C22C 1/0408; C22C 1/0416; C22C 1/0491; C22C 1/05; C22C 1/051; C22C 1/058; C22C 1/10; C22C 1/1005; C22C 1/101; C22C 1/1015; C22C 1/1026; C22C 1/1036; C22C 1/1068; C22C 2001/1047; C22C 2001/1052; C22C 2001/1089; C22C 23/00; C22C 23/02; C22C 23/04; C22C 23/06; C22C 29/00; C22C 29/005; C22C 29/12; C22C 32/0005; C22C 32/001; C22C 32/0015; C22C 32/0036; C22C 45/005; C22C 49/00; C22C 49/02; C22C 49/04; C22C 49/14; C22C 2200/06
See application file for complete search history.

(56) References Cited

OTHER PUBLICATIONS

Wipo patentscope machine translation of CN 103924140, generated Jul. 25, 2018 (Year: 2018).
Wipo patentscope machine translation of JP5429702, generated Jul. 25, 2018 (Year: 2018).

* cited by examiner

METHOD FOR MANUFACTURING QUASICRYSTAL AND ALUMINA MIXED PARTICULATE REINFORCED MAGNESIUM-BASED COMPOSITE MATERIAL

CROSS-REFERENCE TO RELATED APPLICATIONS

This application is a divisional application of U.S. patent application Ser. No. 15/016,390, filed Feb. 5, 2016, which claims priority to Chinese Application No. 201510061456.3, filed Feb. 6, 2015, the contents of each of which is hereby incorporated herein by reference.

BACKGROUND

Field of Invention

The present invention relates to a magnesium alloy, and particularly to a quasicrystal and alumina mixture particles reinforced magnesium matrix composite; the present invention also relates to a method for manufacturing the quasicrystal and alumina mixture particles reinforced magnesium matrix composite.

Background of the Invention

Since magnesium alloys have the advantages of low density, good vibration damping behavior, easy processing, good electromagnetic shielding and the like, they are widely used in the fields of aerospace, automotive transportation, digital products and the like; wherein, Mg—Al—Zn magnesium alloys become a hot spot in research and application field of the magnesium alloys due to their excellent mechanical property, good fluidity, low thermal cracking tendency, relatively simple casting process and low cost. However, Mg—Al—Zn magnesium alloys are easily oxidized to burn during smelting and inherit the disadvantages of low tensile strength and low elongation of traditional magnesium alloys, so that further application of the magnesium alloys is hindered in structural materials. Thus, a method for preparing magnesium matrix composites by adding a reinforcement phase is usually adopted to improve the properties of the magnesium alloys.

Currently, research for a non-continuous reinforced magnesium matrix composite is mainly active internationally, and a reinforcement phase of the non-continuous reinforced magnesium matrix composite mainly is silicon carbide (SiC) particles, boron carbide ($B_4C$) particles, silicon carbide (SiC) whiskers, carbon nanotubes, and so on. And particularly, particles-reinforced magnesium matrix composites become one of development direction of composite materials at present because of the advantages of simple manufacturing process, low cost, workability, isotropy and the like. In addition, an interface is an important characteristic of the composite materials, interface reaction and interface formation play a decisive role for the properties of the composite materials. In the process of manufacturing the composite materials, the reinforcement phase of matrix is likely to react and form a new compound at the interface. However, for a common method for reinforcing the magnesium matrix composites by only adding ceramic particles, there are the problems of poor wettability between the particles and the matrix, poor interface reaction, outdated preparation process and high production cost, which largely restrict improvement of the comprehensive properties of the magnesium matrix composites and limit their wider application.

Currently, there are the following main methods for preparing the particles reinforced magnesium matrix composites: 1. a hot-pressing method in which pressing is conducted in a heating state so as to increase density of microscopic structure of the materials, thereby achieving a reinforcement purpose; 2. a hot-rolling method which only applies to processing of section bars and bars generally and does not apply to preparation of magnesium-based alloy parts having complex shapes and high performance; 3. a stirring-casting method in which a conventional casting method is adopted and reinforcement particles are added into a liquid or semi-solid melt so as to obtain a magnesium matrix composite, since solidification and crystallization perform under gravity, pores, cracks, shrinkage porosities and other defects easily occur, these factors result in that it is difficult to achieve the expected reinforcement effect. 4. a powder metallurgy method in which a particles reinforcement phase and a magnesium alloy matrix powder are squeezed or sintered using a powder metallurgy technique at high temperature to form a composite material—method has relatively high cost and is not conducive to industrializing production.

SUMMARY

The primary object of the present invention is to overcome the problems of the prior art and to provide a quasicrystal and alumina mixture particles reinforced magnesium matrix composite having excellent tensile property and high elongation.

To solve the above-mentioned technical problems, a quasicrystal and alumina mixture particles reinforced magnesium matrix composite of the present invention has the following raw components of a quasicrystal and alumina mixture particles reinforcement phase and a magnesium alloy matrix, and the weight ratio of a quasicrystal and alumina mixture particles reinforcement phase to a magnesium alloy matrix is (4-8) to 100; the magnesium alloy matrix has the following raw components by weight: 1000 parts of magnesium, 90 parts of aluminum, 10 parts of zinc, 1.5-5 parts of manganese, 0.5-1 part of silicon and 0.1-0.5 part of calcium; the quasicrystal and alumina mixture particles reinforcement phase has the following raw components by weight: 40 parts of magnesium, 50-60 parts of zinc, 5-10 parts of yttrium and 8-20 parts of nanometer alumina particles of which the diameter is 20-30 nm; and the size of the quasicrystal and alumina mixture particles reinforcement phase is 100-200 mesh.

Relative to the prior art, the present invention achieves the following beneficial effects: ①Mg has the atomic radius of 0.160 nm, Zn has the atomic radius of 0.133 nm, Y has the atomic radius of 0.181 nm; difference between the atomic radius of Zn and the atomic radius of Mg is 16.75%, difference between the atomic radius of Y and the atomic radius of Mg is 13.13%, because difference among the atomic radius of Mg, the atomic radius of Zn and the atomic radius of Y is great, large lattice distortion arises in the formation of Mg—Zn—Y ternary alloys, which avails the formation of quasicrystals in the structure. The maximum solid solubilities are 8.4% and 12.5% separately when Zn and Y respectively form binary alloys with Mg; the solid solubilities of Zn and Y in Mg are low when a ternary alloy is formed; and therefore, during solidification of the alloys, Zn and Y atoms diffuse into Mg melt and generate concentration fluctuation due to redistribution of solutes, and a MgZnY quasicrystal can be formed completely on the chemical composition of the alloy when the contents of Zn and Y in the front edge of dendrites accumulate to a certain extent; a MgZnY quasicrystal can be formed on the basis of the components and their weight ratio of the present invention. ② The MgZnY quasicrystal of the present invention is between a crystal and an amorphous body, meanwhile has solid ordered phase with long-range quasi-periodic translational order and non-crystallographic rotational symmetry, and has the advantages of good high-temperature stability, high hardness, high modulus, low interfacial energy and good wettability with the magnesium alloy matrix, by which the MgZnY quasicrystal is a very suitable reinforcement phase for the magnesium alloy matrix having soft tenacity. ③ Alumina ceramic particles have melting point of 2050° C., have the characteristics of high refractoriness, high hardness, good corrosion resistance, good electric insulativity and the like, and are insoluble in water, by which the alumina ceramic particles can increase corrosion resistance of magnesium matrix composites while strength of the magnesium matrix composites is improved. The alumina particles react with magnesium on the surfaces of the alumina particles to produce a small amount of MgO and spinel $MgAl_2O_4$ which are well as a binding agent and improve wettability between the reinforcement particles and the matrix. Currently, the micrometre-scale ceramic particles are most commonly used in preparation of the magnesium matrix composites to increase strength of the magnesium alloy matrix, but the elongation lowers, therefore, the use of the nano-scale alumina particles as a reinforcement body can improve strength of the magnesium alloy matrix while ensuring elongation of the magnesium alloy matrix. ④ The present invention improves the following problems existing at a time of only adding the ceramic particles as a reinforcement phase: poor wettability with the matrix, complex preparation process and inapparent reinforcement effect; using quasi-crystal and alumina mixture particles as a reinforcement phase, the tensile property of the magnesium matrix composites may reach more than 190 MPa and the elongation thereof reaches more than 6.5%. ⑤ Aluminum has a great solid solubility in magnesium, wherein the maximum solid solubility at the eutectic temperature of 437° C. reaches 12.5%, and solid solubility changes significantly with decreasing of the temperature. Aluminum can not only have a solid solution strengthening effect in the alloy of the present invention, but also can generate precipitation strengthening effect by quenching and aging treatment. Too high aluminum content results in great difference in electrode potential between ($Mg_{17}Al_{12}$) phase and α (Mg) matrix, thereby causing stress corrosion; aluminum content ratio of the present invention ensures the solid solution strengthening effect of aluminum and avoids stress corrosion. ⑥ Solid solubility of zinc in magnesium significantly reduces as the temperature decreases, zinc content of the present invention can play both solid solution strengthening and precipitation strengthening effects, and can avoid increasing crystallization temperature interval of the alloy and increasing heat cracking and shrinkage tendencies of the alloy due to too high zinc content. Manganese has a small solid solubility in magnesium and does not form a compound with magnesium, but manganese produces a compound having high melting point with impurity element Fe to precipitate out, thereby removing harmful element Fe to improve corrosion resistance of the magnesium alloy of the present invention. ⑦ In the present invention, Calcium (Ca) is added into a Mg—Al alloy and forms $(Mg, Al)_2Ca$ compound with Mg and Al, wherein $(Mg, Al)_2Ca$ compound has a hexagonal crystal structure similar to magnesium and forms a strong interface with the matrix; the $(Mg, Al)_2Ca$ has thermal stability, strong interfacial binding force and a pinning effect at grain boundaries, thereby improving overall creep resistance of the magnesium alloy of the present invention. ⑧ In the present invention, silicon forms a strengthening phase $Mg_2Si$ having a high melting point with magnesium, and forms a stable silicide with other elements, thereby improving the creep properties of the magnesium alloy of the present invention.

As a preferred solution of the present invention, the quasicrystal and alumina mixture particles reinforced magnesium matrix composite has the following raw components of a quasicrystal and alumina mixture particles reinforcement phase and a magnesium alloy matrix, and the weight ratio of the quasicrystal and alumina mixture particles reinforcement phase to the magnesium alloy matrix is 4 to 100; the magnesium alloy matrix has the following raw components by weight: 1000 parts of magnesium, 90 parts of aluminum, 10 parts of zinc, 1.5 parts of manganese, 0.5 part of silicon and 0.1 part of calcium; the quasicrystal and alumina mixture particles reinforcement phase has the following raw components by weight: 40 parts of magnesium, 50 parts of zinc, 5 parts of yttrium and 8 parts of nanometer alumina particles of which the diameter is 20 nm; and the size of the quasicrystal and alumina mixture particles reinforcement phase is 100 mesh.

As a preferred solution of the present invention, the quasicrystal and alumina mixture particles reinforced magnesium matrix composite has the following raw components of a quasicrystal and alumina mixture particles reinforcement phase and a magnesium alloy matrix, and the weight ratio of the quasicrystal and alumina mixture particles reinforcement phase to the magnesium alloy matrix is 6 to 100; the magnesium alloy matrix has the following raw components by weight: 1000 parts of magnesium, 90 parts of aluminum, 10 parts of zinc, 3 parts of manganese, 0.7 part of silicon and 0.3 part of calcium; the quasicrystal and alumina mixture particles reinforcement phase has the following raw components by weight: 40 parts of magnesium, 55 parts of zinc, 8 parts of yttrium and 14 parts of nanometer alumina particles of which the diameter is 25 nm; and the size of the quasicrystal and alumina mixture particles reinforcement phase is 150 mesh.

As a preferred solution of the present invention, the quasicrystal and alumina mixture particles reinforced magnesium matrix composite has the following raw components of a quasicrystal and alumina mixture particles reinforcement phase and a magnesium alloy matrix, and the weight ratio of the quasicrystal and alumina mixture particles reinforcement phase to the magnesium alloy matrix is 8 to 100; the magnesium alloy matrix has the following raw components by weight: 1000 parts of magnesium, 90 parts of aluminum, 10 parts of zinc, 5 parts of manganese, 1 part of silicon and 0.5 part of calcium; the quasicrystal and alumina mixture particles reinforcement phase has the following raw components by weight: 40 parts of magnesium, 60 parts of zinc, 10 parts of yttrium and 20 parts of nanometer alumina particles of which the diameter is 30 nm; and the size of the quasicrystal and alumina mixture particles reinforcement phase is 200 mesh.

As a preferred solution of the present invention, the quasicrystal and alumina mixture particles reinforced magnesium matrix composite has the microstructure characteristics of α-Mg solid solution, $Mg_{17}Al_{12}$ distributed in a fractured chain form, and the quasicrystal phase and alumina particles diffusively distributed at grain boundaries. The magnesium matrix composite with the microstructure has excellent mechanical properties, high tensile ability and high elongation.

Another object of the present invention is to provide a method for manufacturing a quasicrystal and alumina mixture particles reinforced magnesium matrix composite, the magnesium alloy manufactured by the method has excellent tensile property and high elongation.

To solve the above-mentioned technical problems, a method for manufacturing a quasicrystal and alumina mixture particles reinforced magnesium matrix composite orderly comprises the following steps of:

(1) manufacturing a quasicrystal and alumina mixture particles reinforcement phase:

① preparation of raw materials for manufacturing the quasicrystal and alumina mixture particles reinforcement phase: the raw materials are a pure magnesium ingot, a pure zinc ingot, a magnesium-yttrium alloy in which the content of yttrium is 25% by weight, and nanometer alumina particles; each of the elements has the following proportion by weight: 40 parts of magnesium, 50-60 parts of zinc, 5-10 parts of yttrium and 8-20 parts of nanometer alumina particles of which the diameter is 20-30 nm;

② pretreatment of the metal raw materials: the pure magnesium ingot, the pure zinc ingot and the magnesium-yttrium alloy are cut into blocks, oxides attached on the surface of each metal block are removed, and followed by being put into a resistance furnace to preheat and keep at 180° C. to 200° C. for 20 minutes to 30 minutes, so as to remove moisture attached on the surface of each metal block;

③ pretreatment of the nanometer alumina particles: the nanometer alumina particles are put into a beaker, absolute ethyl alcohol is added, and followed by being placed in an ultrasonic cleaner to shock for 15 minutes to 20 minutes, the absolute ethyl alcohol is filtered out after standing, and then drying is conducted in an oven at 590° C. to 610° C. for 5 minutes to 8 minutes so as to completely evaporate the absolute ethyl alcohol; the ultrasonic cleaner has frequency of 20 KHz and power of 1000 W;

④ flux-free smelting under a shielding gas: the pretreated pure magnesium ingot in step ② is put into a crucible of a melting furnace after the crucible is preheated to dark red, when the temperature of the crucible continues to rise to more than 400° C., the shielding gas is continuously provided to keep the subsequent smelting under protective atmosphere;

⑤ homogenizing treatment of an alloy melt: the pure zinc ingot is added after the pure magnesium ingot is completely melted at 700° C., the alloy melt is stirred to homogenize after the pure zinc ingot is completely melted, so as to separate oxides from the melt, and then impurities on the surface are removed; followed by continuously being heated up to 760° C., the magnesium-yttrium alloy is added, stirring is conducted to homogenize the alloy melt after the magnesium-yttrium alloy is completely melted;

⑥ addition of the nanometer alumina particles: the alloy melt of step ⑤ was stood to cool to 700° C., and then the nanometer alumina particles coated by a magnesium foil are pressed into the alloy melt and stirring is conducted for 3 minutes so as to get diffusion of the nanometer alumina particles in the alloy melt to be fully and uniformly; standing is performed for 10 minutes to 15 minutes after stirring, and then impurities and oxides on the surface are removed;

⑦ pouring: the alloy melt was poured into a metal mould preheated to 200° C. in advance and is taken out after solidification, thereby obtaining a quasicrystal and alumina mixture reinforcement phase;

⑧ ball-milling of the quasicrystal and alumina mixture reinforcement phase: the resulting quasicrystal and alumina mixture reinforcement phase in step ⑦ is physically broken, the alloy pieces are added into a planetary ball mill and are milled, and then particles having the size of 100 to 200 mesh are screened out using a stainless steel sieve, thereby obtaining the quasicrystal and alumina mixture particles reinforcement phase;

(2) manufacturing a particles reinforcement phase-magnesium alloy matrix melt mixture slurry:

① preparation of raw materials for smelting the magnesium alloy matrix: the raw materials are a pure magnesium ingot, a pure aluminum ingot, a pure zinc ingot, a magnesium-manganese alloy, a magnesium-silicon alloy and a magnesium-calcium alloy; each of the elements has the following proportion by weight: 1000 parts of magnesium, 90 parts of aluminum, 10 parts of zinc, 1.5-5 parts of manganese, 0.5-1 part of silicon and 0.1-0.5 part of calcium;

② pretreatment of the metal raw materials: the pure magnesium ingot, the pure aluminum ingot, the pure zinc ingot, the magnesium-manganese alloy, the magnesium-silicon alloy and the magnesium-calcium alloy are cut into blocks, oxides attached on the surface of each metal block are removed, and followed by being put into a resistance furnace to preheat and keep at 180° C. to 200° C. for 20 minutes to 30 minutes, so as to remove moisture attached on the surface of each metal block;

③ flux-free smelting under a shielding gas: the pure magnesium ingot and the pure aluminum ingot are put into a crucible and are heated up to 700° C. to melt after the crucible is preheated to dark red, when the temperature rises to more than 400° C., the shielding gas is continuously provided to keep the subsequent smelting under protective atmosphere, thereby preventing the magnesium alloy melt from oxidizing and burning;

④ homogenizing treatment of an alloy melt: the preheated magnesium-manganese alloy is added at 700° C. after the metals are completely melted, the preheated pure zinc ingot sequentially is added at 700° C. after melting, the alloy melt is stirred to homogenize after melting, so as to separate oxides from the melt, and then impurities on the surface are removed; followed by continuously being heated up to 720° C., the preheated magnesium-silicon alloy and the preheated magnesium-calcium alloy are added, thereby obtaining a magnesium alloy matrix melt after melting, and then stirring is conducted to homogenize the magnesium alloy matrix melt;

⑤ the quasicrystal and the alumina mixture particles reinforcement phase in step (1) is coated using an aluminum foil and then is pressed into the magnesium alloy matrix melt, whereafter, the quasicrystal and alumina mixture particles reinforcement phase is mixed with the magnesium alloy matrix melt to be homogenous by staged variable speed stirring, thereby obtaining the particles reinforcement phase-magnesium alloy matrix melt mixture slurry; the weight ratio of the quasicrystal and alumina mixture particles reinforcement phase to the magnesium alloy matrix is (4-8):100;

⑥ the particles reinforcement phase-magnesium alloy matrix melt mixture slurry was allowed to stand for 10 minutes to 15 minutes, so as to separate oxides from the melt, and then impurities on the surface are removed;

(3) casting ingot by pouring and extrusion:

① the particles reinforcement phase-magnesium alloy matrix melt mixture slurry is cooled to 700° C. in the crucible of the smelting furnace;

② a steel mould in an extruder is preheated to 180° C.~200° C.;

③ a cover of the smelting furnace is opened, followed by being aligned with a pouring gate of the mould of the extruder, and then pouring is conducted until the cavity is filled;

④ the extruder performs die closing and extrusion under extrusion pressure of 100 MPa for 15 seconds to 20 seconds; by pressure of the punch of the extruder, the particles reinforcement phase-magnesium alloy matrix melt mixture slurry in the cavity of the mould generates high pressure solidification and plastic deformation under mechanical static pressure of 100 MPa; the mould is opened after the ingot and the mould are cooled to room temperature naturally, and then an ejector pin device protrudes out from a base of the extruder and pushes out the ingot, thereby obtaining the finished product of the quasicrystal and alumina mixture particles reinforced magnesium matrix composite.

Besides the above-mentioned technical effects, the present invention also obtains the following beneficial effects in comparison with the prior art: ① for the existing method for preparing particles reinforced magnesium matrix composites in which single ceramic particles as reinforced phase are added generally, there are the problems of poor wettability between the ceramic particles and the matrix, complex preparation process and inapparent reinforcement effect, in the preparation method of the present invention, a mixture particles intermediate alloy containing nanometer-scale alumina particles and quasicrystal phase as reinforcement phase is firstly prepared, and then a 'staged variable speed stirring and extrusion casting' method is adopted to prepare a magnesium matrix composite, so as to uniformly distribute the quasicrystal and alumina mixture particles reinforcement phase in the matrix melt and avoid mixing with gas and impurities, which is more beneficial to diffuse distribution of the reinforcement phase in the magnesium matrix. The mixture slurry containing the reinforcement phase solidifies and crystallizes under mechanical high pressure of 100 MPa, by which the phenomenons of aggregation, segregation and micropores of the particles reinforcement phase are effectively avoided, so as to uniformly and diffusively distribute the reinforcement phase in the magnesium alloy matrix and closely combine the reinforcement phase with the magnesium alloy matrix, thereby forming a uniform particles reinforced composite material; and meanwhile, under mechanical static pressure of 100 MPa, pores, contraction cavities and shrinkage porosity and other defects inside the magnesium matrix composite can be eliminated, and partial plastic distortion rises, so as to get the structure of the composite material to be dense, to markedly increase strength and hardness of the magnesium matrix composite and shorten the forming process. ② Interface reaction between the reinforcement phase and the matrix plays a decisive role for properties of the composite materials, the magnesium matrix composites are reinforced depending on the ability of stress transfer from the matrix to relatively strong reinforcement phase. If interface combination is brittle, the interface will be invalid before any effective stress is passed to the reinforcement phase, therefore, reinforcement is not obtained. Since the quasi-crystal phase has a low surface energy, belongs to the same kinds of materials with the matrix, and has a very good wettability with the matrix, it is not easy for the quasi-crystal phase particles of the present invention at the grain boundaries to be out of the matrix, thereby being capable to avoid generating micropores and cracks. And no interfacial reaction between the quasi-crystalline phase and the magnesium alloy matrix is performed, and thus a new brittle phase is not formed at the interface. Voids are not formed at the interface when fracture occurs, so as to make the composite material have a large amount of deformation, thereby being capable to significantly improve plasticity and tensile strength thereof, and specifically tensile property of the present invention can reach more than 190 MPa and elongation reaches more than 6.5%. ③ A part of alumina particles in mixture reinforcement phase are in contact with the alloy melt and diffuses thereinto to occur interface reaction, $Al_2O_3+{}_3Mg\rightarrow{}_2Al+{}_3MgO$, $Al_2O_{3+3}MgO\rightarrow MgAl_2O_4$, thereby forming spinel $MgAl_2O_4$. And the spinel as a good binding agent can better promote bonding of interface between the reinforcement phase and the matrix, thereby reducing the adverse effects of interface reaction. During solidification, the quasi-crystalline phase and $Al_2O_3$ particles reinforcement phase diffused into the matrix may be as heterogeneous nucleation center of a primary phase of the alloy melt to increase nucleation rate, and the reinforcement phase enriched at grain boundaries has an effect of hindering coarsening of the primary phase, so as to make grain of the magnesium alloy matrix be refined, therefore, mechanical properties of the magnesium matrix composites can be significantly increased under the dual action of the mixture particles reinforcement phase. ④ Using extrusion casting, mold filling of the metal melt can be conducted at low speed, solidification is conducted under high pressure, and finally a dense and heat-treatable casting is obtained. Under pressure of 100 MPa, firstly, the primary a dendrite arm spacing of the crystalline magnesium alloy is small so that the primary a dendrites turn into tiny petal crystals from the typical coarse dendrites, and the dendrites are fused and broken by the forced convection under high pressure so as to make grains per unit volume increase to refine grain, thereby refining grains and improving mechanical properties of the magnesium alloy; secondly, the metal is in close contact with the internal surface of the mold so that heat transfer is speed up, thereby obtaining a casting having dense microstructure; thirdly, the punch exerts pressure on the casting in the solidification process, which is conducive to feeding, thereby obtaining a gas-tight casting without defects of pore and shrinkage.

As a preferred solution of the present invention, the shielding gas in step (1) and step (2) is a mixture gas of air, carbon dioxide and tetrafluoroethane, the volume ratio of air, carbon dioxide and tetrafluoroethane in the mixture gas is 74:25:1; the mixture gas is introduced to a position of 1 cm-2 cm above the metal melt surface, the flow rate of the shielding gas is 1 L/min, the exhaust pressure is 0.2 MPa to 0.4 MPa. carbon dioxide has a certain protective effect under a low temperature condition during smelting, that is to say, carbon dioxide reacts with magnesium to form amorphous carbon which exists in the gap of MgO oxidation film to improve density thereof, thereby having a certain protective effect; but the oxidation film becomes hard and brittle so as to crack and lose protective effect when temperature of the melt is more than 700° C.; tetrafluoroethane plays a protective role under a high temperature condition, that is to say, compressed air and carbon dioxide serve as a carrier gas, the shielding gas is covered on the surface of the magnesium alloy melt and forms one layer of dense protective film of which the main ingredient is $MgF_2$ to cut off the air and prevent magnesium alloy from being oxidized, thereby achieving a protective effect for the internal melt.

As a preferred solution of the present invention, the magnesium-manganese alloy, the magnesium-silicon alloy and the magnesium-calcium alloy are coated with an aluminum foil in step (2) and are pressed into the melt by a bell jar, and then stirring is conducted. The magnesium-manganese alloy, the magnesium-silicon alloy and the magnesium-calcium alloy are pressed into the melt after being coated with an aluminum foil, by which exposure can be avoided during adding to prevent them from generating serious oxidation loss, and by which loss of alloy elements caused by density difference can also avoided.

As a preferred solution of the present invention, stirring in the first stage of the staged variable speed stirring is conducted at the speed of 200 rpm/min to 300 rpm/min for 5 minutes to 10 minutes; in the second stage, stirring is conducted at the speed of 1200 rpm/min to 1500 rpm/min for 5 minutes to 10 minutes, and then the speed is reduced to 800 rpm/min to 1000 rpm/min and stirring is continuously conducted for 5 minutes to 10 minutes; in the third stage, the stirring speed is increased again to 1200 rpm/min to 1500 rpm/min, and stirring is continuously conducted for 10 minutes to 20 minutes. The first stage adopts a slow stirring to avoid lifting the melt level too quickly, and the aluminum foil in which the mixture particles reinforcement phase is coated is added into a smelting furnace; in the second stage, stirring is conducted at a high speed firstly and then the speed of stirring is reduced to an intermediate speed, this moment, the melt level drops, a large enough vortex is formed on the surface thereof, and the particles reinforcement phase enters into the melt depending on negative pressure suction of the vortex; in the third stage, the speed of stirring is gradually increased again to sufficiently disperse the particles reinforcement phase having entered the melt.

As a preferred solution of the present invention, the quasicrystal and alumina mixture particles reinforced magnesium matrix composite has the following raw components of a quasicrystal and alumina mixture particles reinforcement phase and a magnesium alloy matrix, and the weight ratio of the quasicrystal and alumina mixture particles reinforcement phase to the magnesium alloy matrix is 6 to 100; the magnesium alloy matrix has the following raw components by weight: 1000 parts of magnesium, 90 parts of aluminum, 10 parts of zinc, 3 parts of manganese, 0.7 part of silicon and 0.3 part of calcium; the quasicrystal and alumina mixture particles reinforcement phase has the following raw components by weight: 40 parts of magnesium, 55 parts of zinc, 8 parts of yttrium and 14 parts of nanometer alumina particles of which the diameter is 25 nm; and the size of the quasicrystal and alumina mixture particles reinforcement phase is 150 mesh.

BRIEF DESCRIPTION OF THE DRAWINGS

The invention will be explained in more detail hereinafter with reference to the drawings.

In FIG. 1, the punch is represented by 1; the cavity is represented by 2; the steel mould is represented by 3; the ejector pin device is represented by 4; the base of the extruder is represented by 5.

DETAILED DESCRIPTION OF THE EMBODIMENTS

Embodiment One

Figure 1:
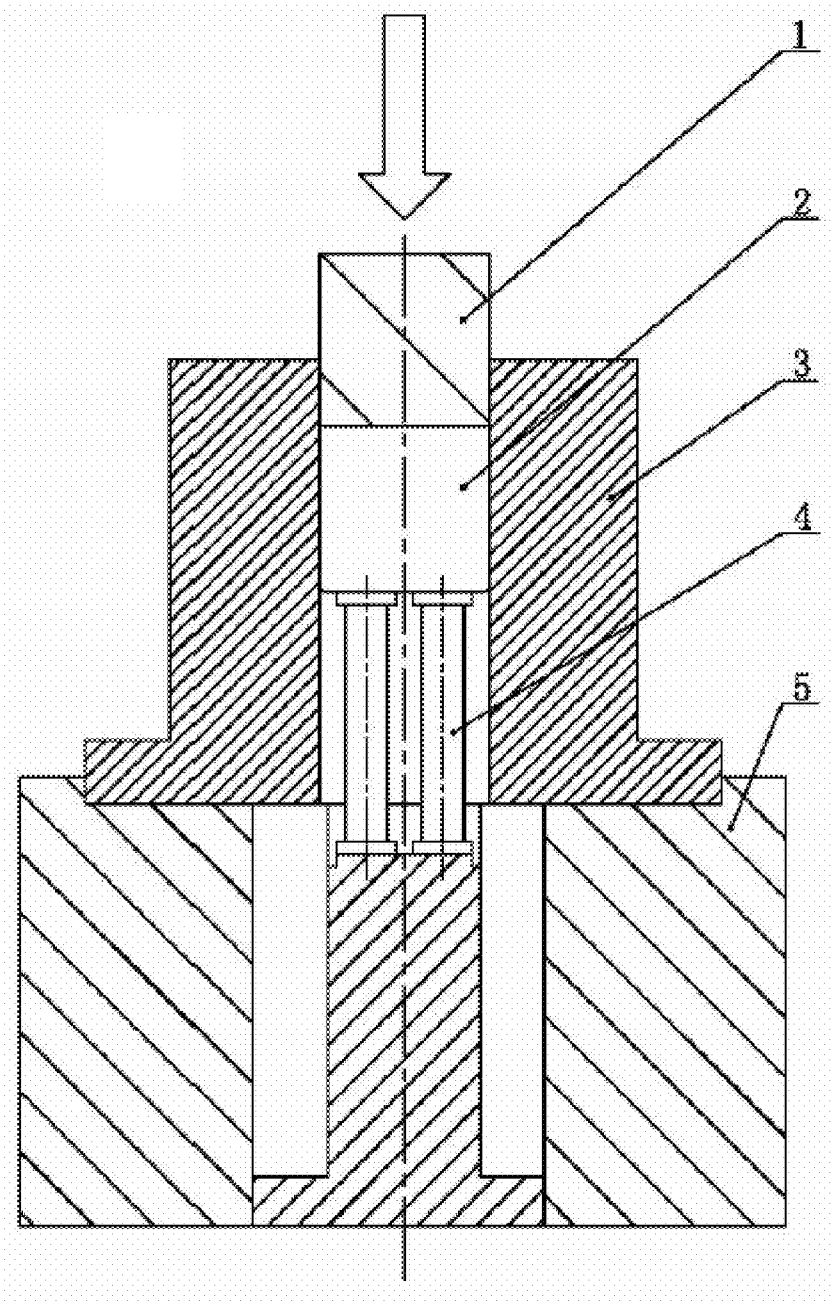
FIG. 1 is a schematic view of extrusion casting mould device used to prepare the magnesium matrix composite in the present invention.

A method for manufacturing a magnesium matrix composite reinforced with quasicrystal and alumina mixture particles in the present invention, orderly comprises the following steps of:

(1) manufacturing a quasicrystal and alumina mixture particles reinforcement phase:

① preparation of raw materials for manufacturing the quasicrystal and alumina mixture particles reinforcement phase: the raw materials are a pure magnesium ingot, a pure zinc ingot, a magnesium-yttrium alloy in which the content of yttrium is 25% by weight, and nanometer alumina particles; each of the elements has the following proportion by weight: 40 parts of magnesium, 50 parts of zinc, 5 parts of yttrium and 8 parts of nanometer alumina particles of which the diameter is 20 nm;

② pretreatment of the metal raw materials: the pure magnesium ingot, the pure zinc ingot and the magnesium-yttrium alloy are cut into blocks, oxides attached on the surface of each metal block are removed, and followed by being put into a resistance furnace to preheat and keep at 180° C. for 20 minutes, so as to remove moisture attached on the surface of each metal block;

③ pretreatment of the nanometer alumina particles: the nanometer alumina particles are put into a beaker, absolute ethyl alcohol is added, and followed by being placed in an ultrasonic cleaner to shock for 15 minutes, the absolute ethyl alcohol is filtered out after standing, and then drying is conducted in an oven at 590° C. for 5 minutes so as to completely evaporate the absolute ethyl alcohol; the ultrasonic cleaner has frequency of 20 KHz and power of 1000 W;

④ flux-free smelting under a shielding gas: the pretreated pure magnesium ingot in step ② is put into a crucible of a melting furnace after the crucible is preheated to dark red, when the temperature of the crucible continues to rise to more than 400° C., the shielding gas is continuously provided to keep the subsequent smelting under protective atmosphere; the shielding gas is a mixture gas of air, carbon dioxide and tetrafluoroethane, the volume ratio of air, carbon dioxide and tetrafluoroethane in the mixture gas is 74:25:1; the mixture gas is introduced to a position of 1 cm above the metal melt surface, the flow rate of the shielding gas is 1 L/min, the exhaust pressure is 0.2 MPa.

⑤ homogenizing treatment of an alloy melt: the pure zinc ingot is added after the pure magnesium ingot is completely melted at 700° C., the alloy melt is stirred to homogenize after the pure zinc ingot is completely melted, so as to separate oxides from the melt, and then impurities on the surface are removed; followed by continuously being heated up to 760° C., the magnesium-yttrium alloy is added, stirring is conducted to homogenize the alloy melt after the magnesium-yttrium alloy is completely melted;

⑥ addition of the nanometer alumina particles: the alloy melt of step ⑤ was stood to cool to 700° C., and then the nanometer alumina particles coated by a magnesium foil are pressed into the alloy melt and stirring is conducted for 3 minutes so as to get diffusion of the nanometer alumina particles in the alloy melt to be fully and uniformly; standing is performed for 10 minutes after stirring, and then impurities and oxides on the surface are removed;

⑦ pouring: the alloy melt was poured into a metal mould preheated to 200° C. in advance and is taken out after solidification, thereby obtaining a quasicrystal and alumina mixture reinforcement phase;

⑧ ball-milling of the quasicrystal and alumina mixture reinforcement phase: the resulting quasicrystal and alumina mixture reinforcement phase in step ⑦ is physically broken, the alloy pieces are added into a planetary ball mill and are milled, and then particles having the size of 100 mesh are screened out using a stainless steel sieve, thereby obtaining the quasicrystal and alumina mixture particles reinforcement phase;

(2) manufacturing a particles reinforcement phase-magnesium alloy matrix melt mixture slurry:

① preparation of raw materials for smelting the magnesium alloy matrix: the raw materials are a pure magnesium ingot, a pure aluminum ingot, a pure zinc ingot, a magnesium-manganese alloy, a magnesium-silicon alloy and a magnesium-calcium alloy; each of the elements has the following proportion by weight: 1000 parts of magnesium, 90 parts of aluminum, 10 parts of zinc, 1.5 parts of manganese, 0.5 part of silicon and 0.1 part of calcium;

② pretreatment of the metal raw materials: the pure magnesium ingot, the pure aluminum ingot, the pure zinc ingot, the magnesium-manganese alloy, the magnesium-silicon alloy and the magnesium-calcium alloy are cut into blocks, oxides attached on the surface of each metal block are removed, and followed by being put into a resistance furnace to preheat and keep at 180° C. for 20 minutes, so as to remove moisture attached on the surface of each metal block;

③ flux-free smelting under a shielding gas: the pure magnesium ingot and the pure aluminum ingot are put into a crucible and are heated up to 700° C. to melt after the crucible is preheated to dark red, when the temperature rises to more than 400° C., the shielding gas is continuously provided to keep the subsequent smelting under protective atmosphere, thereby preventing the magnesium alloy melt from oxidizing and burning; the shielding gas is a mixture gas of air, carbon dioxide and tetrafluoroethane, wherein the volume ratio of air, carbon dioxide and tetrafluoroethane in the mixture gas is 74:25:1, the mixture gas is introduced to a position of 1 cm above the metal melt surface, flow rate of the mixture gas is 1 L/min and exhaust pressure is 0.2 MPa.

④ homogenizing treatment of an alloy melt: the preheated magnesium-manganese alloy is added at 700° C. after the metals are completely melted, the preheated pure zinc ingot sequentially is added at 700° C. after melting, the alloy melt is stirred to homogenize after melting, so as to separate oxides from the melt, and then impurities on the surface are removed; followed by continuously being heated up to 720° C., the preheated magnesium-silicon alloy and the preheated magnesium-calcium alloy are added, thereby obtaining a magnesium alloy matrix melt after melting, and then stirring is conducted to homogenize the magnesium alloy matrix melt; when operating, the magnesium-manganese alloy, the magnesium-silicon alloy and the magnesium-calcium alloy are coated with an aluminum foil, and are pressed into the melt by a bell jar, and then stirring is conducted, by which exposure can be avoided during adding to prevent them from generating serious oxidation loss, and by which loss of alloy elements caused by density difference can also avoided.

⑤ the quasicrystal and the alumina mixture particles reinforcement phase in step (1) is coated using an aluminum foil and then is pressed into the magnesium alloy matrix melt, whereafter, the quasicrystal and alumina mixture particles reinforcement phase is mixed with the magnesium alloy matrix melt to be homogenous by staged variable speed stirring, thereby obtaining the particles reinforcement phase-magnesium alloy matrix melt mixture slurry; the weight ratio of the quasicrystal and alumina mixture particles reinforcement phase to the magnesium alloy matrix is 4:100. Stirring in the first stage of the staged variable speed stirring is conducted at the speed of 200 rpm/min for 5 minutes, a slow speed stirring can avoid lifting the melt level too quickly and can add the aluminum foil in which the mixture particles reinforcement phase is coated into a smelting furnace; in the second stage, firstly, a high speed stirring is conducted at a speed of 1200 rpm/min for 5 minutes, next, stirring speed is reduced to an intermediate speed, the intermediate speed stirring is continued at 800 rpm/min for 5 minutes, this moment, the melt level drops, a large enough vortex is formed on the surface thereof, and the particles reinforcement phase enters into the melt depending on negative pressure suction of the vortex; in the third stage, the stirring speed is increased again to 1200 rpm/min, and stirring is continuously conducted for 10 minutes to sufficiently disperse the particles reinforcement phase having entered the melt.

⑥ the particles reinforcement phase-magnesium alloy matrix melt mixture slurry was allowed to stand for 10 minutes, so as to separate oxides from the melt, and then impurities on the surface are removed;

(3) casting ingot by pouring and extrusion:

① the particles reinforcement phase-magnesium alloy matrix melt mixture slurry is cooled to 700° C. in the crucible of the smelting furnace;

② a steel mould 3 in an extruder is preheated to 180° C.;

③ a cover of the smelting furnace is opened, followed by being aligned with a pouring gate of the mould of the extruder, and then pouring is conducted until the cavity 2 is filled;

④ the extruder performs die closing and extrusion under extrusion pressure of 100 MPa for 15 seconds; by pressure of the punch 1 of the extruder, the particles reinforcement phase-magnesium alloy matrix melt mixture slurry in the cavity of the mould generates high pressure solidification and plastic deformation under mechanical static pressure of 100 MPa; the mould is opened after the ingot and the mould are cooled to room temperature naturally, as shown in FIG. 1, and then an ejector pin device 4 protrudes out from a base of the extruder 5 and pushes out the ingot, thereby obtaining the finished product of the quasicrystal and alumina mixture particles reinforced magnesium matrix composite. The finished product has the microstructure characteristics of α-Mg solid solution, $Mg_{17}Al_{12}$ distributed in a fractured chain form, and the quasicrystal phase and alumina particles diffusively distributed at grain boundaries.

Embodiment Two

A method for manufacturing a quasicrystal and alumina mixture particles reinforced magnesium matrix composite in the present invention, orderly comprises the following steps of:

(1) manufacturing a quasicrystal and alumina mixture particles reinforcement phase:

① preparation of raw materials for manufacturing the quasicrystal and alumina mixture particles reinforcement phase: the raw materials are a pure magnesium ingot, a pure zinc ingot, a magnesium-yttrium alloy in which the content of yttrium is 25% by weight, and nanometer alumina particles; each of the elements has the following proportion by weight: 40 parts of magnesium, 55 parts of zinc, 8 parts of yttrium and 14 parts of nanometer alumina particles of which the diameter is 25 nm;

② pretreatment of the metal raw materials: the pure magnesium ingot, the pure zinc ingot and the magnesium-yttrium alloy are cut into blocks, oxides attached on the surface of each metal block are removed, and followed by being put into a resistance furnace to preheat and keep at 190° C. for 25 minutes, so as to remove moisture attached on the surface of each metal block;

③ pretreatment of the nanometer alumina particles: the nanometer alumina particles are put into a beaker, absolute ethyl alcohol is added, and followed by being placed in an ultrasonic cleaner to shock for 18 minutes, the absolute ethyl alcohol is filtered out after standing, and then drying is conducted in an oven at 600° C. for 7 minutes so as to completely evaporate the absolute ethyl alcohol; the ultrasonic cleaner has frequency of 20 KHz and power of 1000 W;

④ flux-free smelting under a shielding gas: the pretreated pure magnesium ingot in step ② is put into a crucible of a melting furnace after the crucible is preheated to dark red, when the temperature of the crucible continues to rise to more than 400° C., the shielding gas is continuously provided to keep the subsequent smelting under protective atmosphere; the shielding gas is a mixture gas of air, carbon dioxide and tetrafluoroethane, the volume ratio of air, carbon dioxide and tetrafluoroethane in the mixture gas is 74:25:1; the mixture gas is introduced to a position of 1.5 cm above the metal melt surface, the flow rate of the shielding gas is 1 L/min, the exhaust pressure is 0.3 MPa.

⑤ homogenizing treatment of an alloy melt: the pure zinc ingot is added after the pure magnesium ingot is completely melted at 700° C., the alloy melt is stirred to homogenize after the pure zinc ingot is completely melted, so as to separate oxides from the melt, and then impurities on the surface are removed; followed by continuously being heated up to 760° C., the magnesium-yttrium alloy is added, stirring is conducted to homogenize the alloy melt after the magnesium-yttrium alloy is completely melted;

⑥ addition of the nanometer alumina particles: the alloy melt of step ⑤ was stood to cool to 700° C., and then the nanometer alumina particles coated by a magnesium foil are pressed into the alloy melt and stirring is conducted for 3 minutes so as to get diffusion of the nanometer alumina particles in the alloy melt to be fully and uniformly; standing is performed for 13 minutes after stirring, and then impurities and oxides on the surface are removed;

⑦ pouring: the alloy melt was poured into a metal mould preheated to 200° C. in advance and is taken out after solidification, thereby obtaining a quasicrystal and alumina mixture reinforcement phase;

⑧ ball-milling of the quasicrystal and alumina mixture reinforcement phase: the resulting quasicrystal and alumina mixture reinforcement phase in step ⑦ is physically broken, the alloy pieces are added into a planetary ball mill and are milled, and then particles having the size of 150 mesh are screened out using a stainless steel sieve, thereby obtaining the quasicrystal and alumina mixture particles reinforcement phase;

(2) manufacturing a particles reinforcement phase-magnesium alloy matrix melt mixture slurry:

① preparation of raw materials for smelting the magnesium alloy matrix: the raw materials are a pure magnesium ingot, a pure aluminum ingot, a pure zinc ingot, a magnesium-manganese alloy, a magnesium-silicon alloy and a magnesium-calcium alloy; each of the elements has the following proportion by weight: 1000 parts of magnesium, 90 parts of aluminum, 10 parts of zinc, 3 parts of manganese, 0.7 part of silicon and 0.3 part of calcium;

② pretreatment of the metal raw materials: the pure magnesium ingot, the pure aluminum ingot, the pure zinc ingot, the magnesium-manganese alloy, the magnesium-silicon alloy and the magnesium-calcium alloy are cut into blocks, oxides attached on the surface of each metal block are removed, and followed by being put into a resistance furnace to preheat and keep at 190° C. for 25 minutes, so as to remove moisture attached on the surface of each metal block;

③ flux-free smelting under a shielding gas: the pure magnesium ingot and the pure aluminum ingot are put into a crucible and are heated up to 700° C. to melt after the crucible is preheated to dark red, when the temperature rises to more than 400° C., the shielding gas is continuously provided to keep the subsequent smelting under protective atmosphere, thereby preventing the magnesium alloy melt from oxidizing and burning; the shielding gas is a mixture gas of air, carbon dioxide and tetrafluoroethane, wherein the volume ratio of air, carbon dioxide and tetrafluoroethane in the mixture gas is 74:25:1, the mixture gas is introduced to a position of 1.5 cm above the metal melt surface, flow rate of the mixture gas is 1 L/min and exhaust pressure is 0.3 MPa.)

④ homogenizing treatment of an alloy melt: the preheated magnesium-manganese alloy is added at 700° C. after the metals are completely melted, the preheated pure zinc ingot sequentially is added at 700° C. after melting, the alloy melt is stirred to homogenize after melting, so as to separate oxides from the melt, and then impurities on the surface are removed; followed by continuously being heated up to 720° C., the preheated magnesium-silicon alloy and the preheated magnesium-calcium alloy are added, thereby obtaining a magnesium alloy matrix melt after melting, and then stirring is conducted to homogenize the magnesium alloy matrix melt; when operating, the magnesium-manganese alloy, the magnesium-silicon alloy and the magnesium-calcium alloy are coated with an aluminum foil, and are pressed into the melt by a bell jar, and then stirring is conducted, by which exposure can be avoided during adding to prevent them from generating serious oxidation loss, and by which loss of alloy elements caused by density difference can also avoided.

⑤ the quasicrystal and the alumina mixture particles reinforcement phase in step (1) is coated using an aluminum foil and then is pressed into the magnesium alloy matrix melt, whereafter, the quasicrystal and alumina mixture particles reinforcement phase is mixed with the magnesium alloy matrix melt to be homogenous by staged variable speed stirring, thereby obtaining the particles reinforcement phase-magnesium alloy matrix melt mixture slurry; the weight ratio of the quasicrystal and alumina mixture particles reinforcement phase to the magnesium alloy matrix is 6:100. Stirring in the first stage of the staged variable speed stirring is conducted at the speed of 250 rpm/min for 8 minutes, a slow speed stirring can avoid lifting the melt level too quickly and can add the aluminum foil in which the mixture particles reinforcement phase is coated into a smelting furnace; in the second stage, firstly, a high speed stirring is conducted at a speed of 1300 rpm/min for 8 minutes, next, stirring speed is reduced to an intermediate speed, the intermediate speed stirring is continued at 900 rpm/min for 8 minutes, this moment, the melt level drops, a large enough vortex is formed on the surface thereof, and the particles reinforcement phase enters into the melt depending on negative pressure suction of the vortex; in the third stage, the stirring speed is increased again to 1300 rpm/min, and stirring is continuously conducted for 15 minutes to sufficiently disperse the particles reinforcement phase having entered the melt.

⑥ the particles reinforcement phase-magnesium alloy matrix melt mixture slurry was allowed to stand for 13 minutes, so as to separate oxides from the melt, and then impurities on the surface are removed;

(3) casting ingot by pouring and extrusion:

① the particles reinforcement phase-magnesium alloy matrix melt mixture slurry is cooled to 700° C. in the crucible of the smelting furnace;

② a steel mould 3 in an extruder is preheated to 190° C.;

③ a cover of the smelting furnace is opened, followed by being aligned with a pouring gate of the mould of the extruder, and then pouring is conducted until the cavity 2 is filled;

④ the extruder performs die closing and extrusion under extrusion pressure of 100 MPa for 18 seconds; by pressure of the punch 1 of the extruder, the particles reinforcement phase-magnesium alloy matrix melt mixture slurry in the cavity of the mould generates high pressure solidification and plastic deformation under mechanical static pressure of 100 MPa; the mould is opened after the ingot and the mould are cooled to room temperature naturally, as shown in FIG. 1, and then an ejector pin device 4 protrudes out from a base of the extruder 5 and pushes out the ingot, thereby obtaining the finished product of the quasicrystal and alumina mixture particles reinforced magnesium matrix composite. The finished product has the microstructure characteristics of α-Mg solid solution, $Mg_{17}Al_{12}$ distributed in a fractured chain form, and the quasicrystal phase and alumina particles diffusively distributed at grain boundaries.

Embodiment Three

A method for manufacturing a quasicrystal and alumina mixture particles reinforced magnesium matrix composite in the present invention, orderly comprises the following steps of:

(1) manufacturing a quasicrystal and alumina mixture particles reinforcement phase:

① preparation of raw materials for manufacturing the quasicrystal and alumina mixture particles reinforcement phase: the raw materials are a pure magnesium ingot, a pure zinc ingot, a magnesium-yttrium alloy in which the content of yttrium is 25% by weight, and nanometer alumina particles; each of the elements has the following proportion by weight: 40 parts of magnesium, 60 parts of zinc, 10 parts of yttrium and 20 parts of nanometer alumina particles of which the diameter is 30 nm;

② pretreatment of the metal raw materials: the pure magnesium ingot, the pure zinc ingot and the magnesium-yttrium alloy are cut into blocks, oxides attached on the surface of each metal block are removed, and followed by being put into a resistance furnace to preheat and keep at 200° C. for 30 minutes, so as to remove moisture attached on the surface of each metal block;

③ pretreatment of the nanometer alumina particles: the nanometer alumina particles are put into a beaker, absolute ethyl alcohol is added, and followed by being placed in an ultrasonic cleaner to shock for 20 minutes, the absolute ethyl alcohol is filtered out after standing, and then drying is conducted in an oven at 610° C. for 8 minutes so as to completely evaporate the absolute ethyl alcohol; the ultrasonic cleaner has frequency of 20 KHz and power of 1000 W;

④ flux-free smelting under a shielding gas: the pretreated pure magnesium ingot in step ② is put into a crucible of a melting furnace after the crucible is preheated to dark red, when the temperature of the crucible continues to rise to more than 400° C., the shielding gas is continuously provided to keep the subsequent smelting under protective atmosphere; the shielding gas is a mixture gas of air, carbon dioxide and tetrafluoroethane, the volume ratio of air, carbon dioxide and tetrafluoroethane in the mixture gas is 74:25:1; the mixture gas is introduced to a position of 2 cm above the metal melt surface, the flow rate of the shielding gas is 1 L/min, the exhaust pressure is 0.4 MPa.

⑤ homogenizing treatment of an alloy melt: the pure zinc ingot is added after the pure magnesium ingot is completely melted at 700° C., the alloy melt is stirred to homogenize after the pure zinc ingot is completely melted, so as to separate oxides from the melt, and then impurities on the surface are removed; followed by continuously being heated up to 760° C., the magnesium-yttrium alloy is added, stirring is conducted to homogenize the alloy melt after the magnesium-yttrium alloy is completely melted;

⑥ addition of the nanometer alumina particles: the alloy melt of step ⑤ was stood to cool to 700° C., and then the nanometer alumina particles coated by a magnesium foil are pressed into the alloy melt and stirring is conducted for 3 minutes so as to get diffusion of the nanometer alumina particles in the alloy melt to be fully and uniformly; standing is performed for 15 minutes after stirring, and then impurities and oxides on the surface are removed;

⑦ pouring: the alloy melt was poured into a metal mould preheated to 200° C. in advance and is taken out after solidification, thereby obtaining a quasicrystal and alumina mixture reinforcement phase;

⑧ ball-milling of the quasicrystal and alumina mixture reinforcement phase: the resulting quasicrystal and alumina mixture reinforcement phase in step ⑦ is physically broken, the alloy pieces are added into a planetary ball mill and are milled, and then particles having the size of 200 mesh are screened out using a stainless steel sieve, thereby obtaining the quasicrystal and alumina mixture particles reinforcement phase;

(2) manufacturing a particles reinforcement phase-magnesium alloy matrix melt mixture slurry:

① preparation of raw materials for smelting the magnesium alloy matrix: the raw materials are a pure magnesium ingot, a pure aluminum ingot, a pure zinc ingot, a magnesium-manganese alloy, a magnesium-silicon alloy and a magnesium-calcium alloy; each of the elements has the following proportion by weight: 1000 parts of magnesium, 90 parts of aluminum, 10 parts of zinc, 5 parts of manganese, 1 part of silicon and 0.5 part of calcium;

② pretreatment of the metal raw materials: the pure magnesium ingot, the pure aluminum ingot, the pure zinc ingot, the magnesium-manganese alloy, the magnesium-silicon alloy and the magnesium-calcium alloy are cut into blocks, oxides attached on the surface of each metal block are removed, and followed by being put into a resistance furnace to preheat and keep at 200° C. for 30 minutes, so as to remove moisture attached on the surface of each metal block;

③ flux-free smelting under a shielding gas: the pure magnesium ingot and the pure aluminum ingot are put into a crucible and are heated up to 700° C. to melt after the crucible is preheated to dark red, when the temperature rises to more than 400° C., the shielding gas is continuously provided to keep the subsequent smelting under protective atmosphere, thereby preventing the magnesium alloy melt from oxidizing and burning; the shielding gas is a mixture gas of air, carbon dioxide and tetrafluoroethane, wherein the volume ratio of air, carbon dioxide and tetrafluoroethane in the mixture gas is 74:25:1, the mixture gas is introduced to a position of 2 cm above the metal melt surface, flow rate of the mixture gas is 1 L/min and exhaust pressure is 0.4 MPa.

④ homogenizing treatment of an alloy melt: the preheated magnesium-manganese alloy is added at 700° C. after the metals are completely melted, the preheated pure zinc ingot sequentially is added at 700° C. after melting, the alloy melt is stirred to homogenize after melting, so as to separate oxides from the melt, and then impurities on the surface are removed; followed by continuously being heated up to 720° C., the preheated magnesium-silicon alloy and the preheated magnesium-calcium alloy are added, thereby obtaining a magnesium alloy matrix melt after melting, and then stirring is conducted to homogenize the magnesium alloy matrix melt; when operating, the magnesium-manganese alloy, the magnesium-silicon alloy and the magnesium-calcium alloy are coated with an aluminum foil, and are pressed into the melt by a bell jar, and then stirring is conducted, by which exposure can be avoided during adding to prevent them from generating serious oxidation loss, and by which loss of alloy elements caused by density difference can also avoided.

⑤ the quasicrystal and the alumina mixture particles reinforcement phase in step (1) is coated using an aluminum foil and then is pressed into the magnesium alloy matrix melt, whereafter, the quasicrystal and alumina mixture particles reinforcement phase is mixed with the magnesium alloy matrix melt to be homogenous by staged variable speed stirring, thereby obtaining the particles reinforcement phase-magnesium alloy matrix melt mixture slurry; the weight ratio of the quasicrystal and alumina mixture particles reinforcement phase to the magnesium alloy matrix is 8:100. Stirring in the first stage of the staged variable speed stirring is conducted at the speed of 300 rpm/min for 10 minutes, a slow speed stirring can avoid lifting the melt level too quickly and can add the aluminum foil in which the mixture particles reinforcement phase is coated into a smelting furnace; in the second stage, firstly, a high speed stirring is conducted at a speed of 1500 rpm/min for 10 minutes, next, stirring speed is reduced to an intermediate speed, the intermediate speed stirring is continued at 1000 rpm/min for 10 minutes, this moment, the melt level drops, a large enough vortex is formed on the surface thereof, and the particles reinforcement phase enters into the melt depending on negative pressure suction of the vortex; in the third stage, the stirring speed is increased again to 1500 rpm/min, and stirring is continuously conducted for 20 minutes to sufficiently disperse the particles reinforcement phase having entered the melt.

⑥ the particles reinforcement phase-magnesium alloy matrix melt mixture slurry was allowed to stand for 15 minutes, so as to separate oxides from the melt, and then impurities on the surface are removed;

③ casting ingot by pouring and extrusion:

① the particles reinforcement phase-magnesium alloy matrix melt mixture slurry is cooled to 700° C. in the crucible of the smelting furnace;

② a steel mould 3 in an extruder is preheated to 200° C.;

③ a cover of the smelting furnace is opened, followed by being aligned with a pouring gate of the mould of the extruder, and then pouring is conducted until the cavity 2 is filled;

④ the extruder performs die closing and extrusion under extrusion pressure of 100 MPa for 20 seconds; by pressure of the punch 1 of the extruder, the particles reinforcement phase-magnesium alloy matrix melt mixture slurry in the cavity of the mould generates high pressure solidification and plastic deformation under mechanical static pressure of 100 MPa; the mould is opened after the ingot and the mould are cooled to room temperature naturally, as shown in FIG. 1, and then an ejector pin device 4 protrudes out from a base of the extruder 5 and pushes out the ingot, thereby obtaining the finished product of the quasicrystal and alumina mixture particles reinforced magnesium matrix composite. The finished product has the microstructure characteristics of α-Mg solid solution, $Mg_{17}Al_{12}$ distributed in a fractured chain form, and the quasicrystal phase and alumina particles diffusively distributed at grain boundaries.

At room temperature, performance test is performed for the quasicrystal and alumina mixture particles reinforced magnesium matrix composites of embodiments one to three of the present invention, ZM5 magnesium alloy and magnesium alloy matrix of the present invention, the obtained performance parameters and comparison result are shown in Table 1.

TABLE 1

| | Tensile Strength (MPa) | Elongation (%) |
|---|---|---|
| ZM5 magnesium alloy | 108.3 | 4.12 |
| magnesium alloy matrix of embodiment 2 of the present invention | 94.5 | 2.68 |
| magnesium matrix composite of embodiment 1 of the present invention | 193.9 | 6.25 |
| magnesium matrix composite of embodiment 2 of the present invention | 194.5 | 6.51 |
| magnesium matrix composite of embodiment 3 of the present invention | 195.8 | 6.83 |
| average value of the magnesium matrix composites of the present invention | 194.7 | 6.53 |

As can be seen from table 1, tensile strength of the magnesium alloys of the present invention reaches 194.7 MPa at room temperature, elongation also reaches 6.53% while the tensile strength is increased, both of which are increased sharply compared with those of ZM5 magnesium-based alloy and the magnesium alloy matrix.

Figure 2:
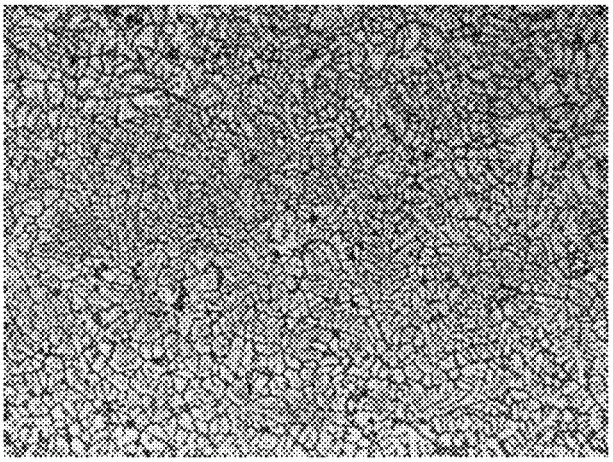
FIG. 2 is a microstructure view of the quasicrystal and alumina mixture particles reinforced magnesium matrix composite of the present invention.

FIG. 2 is a microstructure view of the quasicrystal and alumina mixture particles reinforced magnesium matrix composite of embodiment two of the present invention. As can be seen from FIG. 2, metallurgical microstructure has good compactness.

Figure 3:
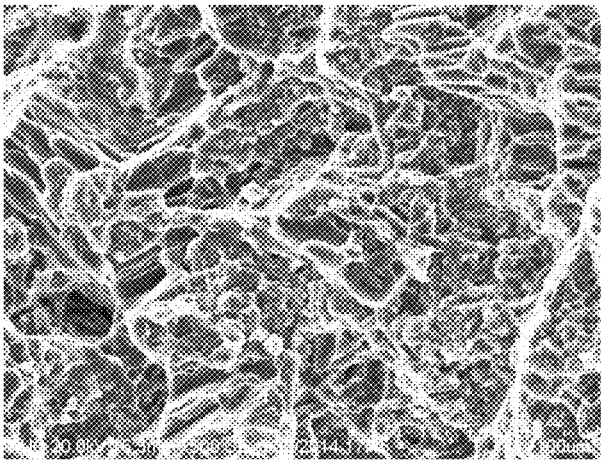
FIG. 3 is a shape appearance view of a tensile specimen fracture of the quasicrystal and alumina mixture particles reinforced magnesium matrix composite of the present invention obtained by a scanning electron microscope.

FIG. 3 a shape appearance view of a tensile specimen fracture of the quasicrystal and alumina mixture particles reinforced magnesium matrix composite of embodiment two of the present invention obtained by a scanning electron microscope. As can be seen from FIG. 3, in the shape appearance of the tensile specimen fracture, there are a large number of dimples of which the diameter becomes small and has a great depth, and cleavage plane becomes tiny, thereby having an obvious quasi cleavage fracture feature.

The above-described content is only preferably practicable embodiments of the present invention without limitation for the protective scope of the present invention.

Besides the above-mentioned embodiments, the present invention may also have other embodiments. All of technical solutions formed by equivalent replacement or equivalent transformation fall within the claimed scope of the present invention. No described technical features in the present invention may be achieved by or using the prior art, therefore, they are not repeated here.

The invention claimed is:

1. A method for manufacturing a quasicrystal and alumina mixture particles reinforced magnesium matrix composite, orderly comprising:

manufacturing a quasicrystal and alumina mixture particles reinforcement phase, comprising preparing raw materials for manufacturing the quasicrystal and alumina mixture particles reinforcement phase comprising a pure magnesium ingot, a pure zinc ingot, a magnesium-yttrium alloy in which the content of yttrium is 25% by weight, and nanometer alumina particles, the elements having the following proportion by weight 40 parts of magnesium, 50-60 parts of zinc, 5-10 parts of yttrium and 8-20 parts of nanometer alumina particles of which the diameter is 20-30 nm;

pretreating metal raw materials, cutting the pure magnesium ingot, the pure zinc ingot and the magnesium-yttrium alloy into metal blocks, removing oxides attached on a surface of each metal block, and placing the metal blocks into a resistance furnace to preheat and keep at 180° C. to 200° C. for 20 minutes to 30 minutes;

pretreating the nanometer alumina particles, including putting the nanometer alumina particles into a beaker, adding absolute ethyl alcohol, placing the nanometer alumina particles in an ultrasonic cleaner to shock for 15 minutes to 20 minutes, and filtering out the absolute ethyl alcohol after standing, and drying in an oven at 590° C. to 610° C. for 5 to 8 minutes so as to completely evaporate the absolute ethyl alcohol where the ultrasonic cleaner has frequency of 20 KHz and power of 1000 W;

flux-free smelting under a first shielding gas, including placing the pretreated pure magnesium ingot into a crucible of a melting furnace after the crucible is preheated to dark red, when the temperature of the crucible continues to rise to more than 400° C., continuously providing the first shielding gas to keep the subsequent smelting under protective atmosphere;

homogenizing treating an alloy melt including, adding the pure zinc ingot after the pure magnesium ingot is completely melted at 700° C., stirring and homogenizing the alloy melt after the pure zinc ingot is completely melted to separate oxides from the melt and to remove impurities on the surface;

continuously heating the alloy melt to 760° C., adding the magnesium-yttrium alloy, stirring to homogenize the alloy melt after the magnesium-yttrium alloy is completely melted;

adding of the nanometer alumina particles including, cooling the alloy melt to 700° C., and coating the nanometer alumina particles with a magnesium foil pressed into the alloy melt and stirring for 3 minutes to get diffusion of the nanometer alumina particles in the alloy melt to be fully and uniformly;

allowing to stand for 10 to 15 minutes after stirring, removing impurities and oxides on the surface;

pouring the alloy melt into a metal mould preheated to 200° C. in advance and removing the quasicrystal and alumina mixture reinforcement phase after solidification;

ball-milling the quasicrystal and alumina mixture reinforcement phase, including breaking the quasicrystal and alumina mixture reinforcement phase, adding alloy pieces into a planetary ball mill and milling the alloy pieces; and screening out particles having the size of 100 to 200 mesh using a stainless steel sieve to obtain the quasicrystal and alumina mixture particles reinforcement phase;

manufacturing a particles reinforcement phase-magnesium alloy matrix melt mixture slurry, including preparing raw materials for smelting the magnesium alloy matrix comprising a pure magnesium ingot, a pure aluminum ingot, a pure zinc ingot, a magnesium-manganese alloy, a magnesium-silicon alloy and a magnesium-calcium alloy; the elements having the following proportion by weight 1000 parts of magnesium, 90 parts of aluminum, 10 parts of zinc, 1.5-5 parts of manganese, 0.5-1 part of silicon and 0.1-0.5 part of calcium;

pretreating metal raw materials, including cutting the pure magnesium ingot, the pure aluminum ingot, the pure zinc ingot, the magnesium-manganese alloy, the magnesium-silicon alloy and the magnesium-calcium alloy into metal blocks, removing oxides attached on a surface of each metal block, and placing the raw materials into a resistance furnace to preheat and keep at 180° C. to 200° C. for 20 minutes to 30 minutes to remove moisture attached on the surface of each metal block; flux-free smelting under a second shielding gas, including placing the pure magnesium ingot and the pure aluminum ingot into a crucible and heating up to 700° C. to melt after the crucible is preheated to dark red, when the temperature rises to more than 400° C., continuously providing the second shielding gas to keep the subsequent smelting under protective atmosphere to prevent a magnesium alloy melt from oxidizing and burning;

homogenizing treating of an alloy melt, including adding the preheated magnesium-manganese alloy at 700° C. after the metals are completely melted, adding the preheated pure zinc ingot sequentially at 700° C. after melting, stirring and homogenizing the alloy melt after melting to separate oxides from the melt and to remove impurities on the surface are removed, continuously heating up to 720° C., adding the preheated magnesium-silicon alloy and the preheated magnesium-calcium alloy, thereby obtaining a magnesium alloy matrix melt after melting, and stirring to homogenize the magnesium alloy matrix melt;

coating the quasicrystal and the alumina mixture particles reinforcement phase using an aluminum foil and pressing the quasicrystal and the alumina mixture particles reinforcement phase into the magnesium alloy matrix melt, mixing the quasicrystal and alumina mixture particles reinforcement phase with the magnesium alloy matrix melt to be homogenous by staged variable speed stirring, thereby obtaining the particles reinforcement phase-magnesium alloy matrix melt mixture slurry where the weight ratio of the quasicrystal and alumina mixture particles reinforcement phase to the magnesium alloy matrix is (4-8):100;

allowing the particles reinforcement phase-magnesium alloy matrix melt mixture slurry to stand for 10 to 15 minutes, so as to separate oxides from the melt, and to remove impurities on the surface;

casting ingot by pouring and extrusion, including cooling the particles reinforcement phase-magnesium alloy matrix melt mixture slurry to 700° C. in a crucible of the smelting furnace;

preheating a steel mould in an extruder to 180° C. ~200° C.;

opening a cover of the smelting furnace, and aligning the cover with a pouring gate of the mould of the extruder, and pouring until a cavity is filled;

performing die closing and extrusion by the extruder under extrusion pressure of 100 MPa for 15 to 20 seconds; by the pressure of a punch of the extruder, the particles reinforcement phase-magnesium alloy matrix melt mixture slurry in the cavity of the mould generates high pressure solidification and plastic deformation under mechanical static pressure of 100 MPa, cooling the ingot and the mould to room temperature naturally;

opening the mould, and pushing out the ingot using an ejector pin device protruding out from a base of the extruder, thereby obtaining the finished product of the quasicrystal and alumina mixture particles reinforced magnesium matrix composite.

2. The method for manufacturing a quasicrystal and alumina mixture particles reinforced magnesium matrix composite according to claim 1, wherein at least one of the first shielding gas and the second shielding gas is a mixture gas of air, carbon dioxide and tetrafluoroethane, and the volume ratio of air, carbon dioxide and tetrafluoroethane in the mixture gas is 74:25:1, the mixture gas is introduced to a position of 1 cm-2 cm above a metal melt surface, the flow rate of the shielding gas is 1 L/min, the exhaust pressure is 0.2 MPa to 0.4 MPa.

3. The method for manufacturing a quasicrystal and alumina mixture particles reinforced magnesium matrix composite according to claim 1, wherein the magnesium-manganese alloy, the magnesium-silicon alloy and the magnesium-calcium alloy are coated with an aluminum foil, and are pressed into the melt by a bell jar prior to stirring.

4. The method for manufacturing a quasicrystal and alumina mixture particles reinforced magnesium matrix composite according to claim 1, wherein stirring in a first stage of the staged variable speed stirring is at the speed of 200 to 300 rpm/min for 5 to 10 minutes; in a second stage, stirring is at the speed of 1200 to 1500 rpm/min for 5 to 10 minutes, and then the speed is reduced to 800 to 1000 rpm/min and stirring is continuously conducted for 5 to 10 minutes; in a third stage, the stirring speed is increased to 1200 to 1500 rpm/min, stirring continuously for 10 to 20 minutes.

5. The method for manufacturing a quasicrystal and alumina mixture particles reinforced magnesium matrix composite according to claim 1, wherein the quasicrystal and alumina mixture particles reinforced magnesium matrix composite comprises a quasicrystal and alumina mixture particles reinforcement phase and a magnesium alloy matrix, and the weight ratio of the quasicrystal and alumina mixture particles reinforcement phase to the magnesium alloy matrix is 6 to 100;

the magnesium alloy matrix comprises by weight 1000 parts of magnesium, 90 parts of aluminum, 10 parts of zinc, 3 parts of manganese, 0.7 part of silicon and 0.3 part of calcium;

the quasicrystal and alumina mixture particles reinforcement phase comprises by weight 40 parts of magnesium, 55 parts of zinc, 8 parts of yttrium and 14 parts of nanometer alumina particles of which the diameter is 25 nm; and the size of the quasicrystal and alumina mixture particles reinforcement phase is 150 mesh.

6. The method for manufacturing a quasicrystal and alumina mixture particles reinforced magnesium matrix composite according to claim 1, wherein the quasicrystal and alumina mixture particles reinforced magnesium matrix composite has microstructure characteristics of α-Mg solid solution, $Mg_{17}Al_{12}$ distributed in a fractured chain form, and the quasicrystal phase and alumina particles diffusively distributed at grain boundaries.

* * * * *